United States Patent [19]

Zeidman

[11] Patent Number: 5,072,566

[45] Date of Patent: Dec. 17, 1991

[54] LANDSCAPING BLOCK

[76] Inventor: Philip A. Zeidman, 100 Foley Ave., Santa Rosa, Calif. 95401

[21] Appl. No.: 586,817

[22] Filed: Sep. 24, 1990

[51] Int. Cl.[5] ..... E04B 5/04; E04C 2/04

[52] U.S. Cl. ..... 52/608; 52/604; 52/605; 405/119

[58] Field of Search ..... 52/16, 608, 609, 604, 52/605; 405/119, 592, 284–286

[56] References Cited

U.S. PATENT DOCUMENTS 1,606,150 11/1924 Curtis ..... 52/608
4,345,853 8/1982 Fisher ..... 52/16

FOREIGN PATENT DOCUMENTS 0013535 7/1980 European Pat. Off. ..... 52/604
2537408 4/1976 Fed. Rep. of Germany ..... 52/608
918619 2/1947 France ..... 72/37

*Primary Examiner*—Richard E. Chilcot, Jr.
*Assistant Examiner*—Kien T. Nguyen
*Attorney, Agent, or Firm*—Burns, Doane, Swecker and Mathis

[57] ABSTRACT

A landscaping block for a retaining wall includes a bottom wall, a pair of side walls, first and second end walls, and upper and lower steps on the side walls for interlocking with overlying and underlying blocks. The blocks also include a transversely extending step that extends downwardly from one end of the bottom wall for engaging an underlying block while preventing a front wall of an overlying block from contacting the front wall of the underlying block.

20 Claims, 4 Drawing Sheets

LANDSCAPING BLOCK

BACKGROUND OF THE INVENTION

1. Field of the Invention

The present invention relates to landscaping blocks for use with retaining walls and, more particularly, to landscaping blocks for preventing longitudinal and lateral displacement of a retaining wall.

2. State of the Art

There are a number of prior art building blocks which can be used for building walls with or without mortar or for building retaining walls and for stabilizing slopes as protection against erosion damages or slides. Such blocks are usually arranged in courses in an open form of construction so that the intervening spaces can be filled with dirt whereby plants or grass can be grown in such spaces. For example, various building block constructions are shown in U.S. Pat. No. 379,338 (Steinau), U.S. Pat. No. 1,542,909 (Regan), U.S. Pat. No. 2,737,801 (Barnhart), U.S. Pat. No. 3,073,061 (Pearson), U.S. Design Pat. No. 217,244 (Fairfield), U.S. Design Pat. No. 230,846 (Friederich, et al.) and U.S. Design Pat. No. 264,996 (Siedschlag).

A shortcoming of the prior art retaining wall blocks, however, is the provision of a block for a retaining wall which offers load bearing and innerlocking possibilities to prevent longitudinal and transverse displacement of the blocks relative to each other. Furthermore, there is a need in the art for a building block arrangement wherein the building blocks cover a surface area with a minimum number of blocks.

SUMMARY OF THE INVENTION

An object of the present invention is to provide a landscaping block arrangement which utilizes a minimum number of blocks to cover a large surface area for forming a retaining wall. An additional object of the invention is to provide a landscaping block arrangement wherein the individual blocks include means for preventing lateral and/or longitudinal displacement of the blocks relative to each other in the assembled condition.

In particular, an object of the invention is to provide a landscaping block which includes means for vertically engaging and preventing lateral displacement of individual blocks which are identical to each other when the blocks form a retaining wall wherein the sidewalls of each of the blocks are parallel to each other and the sidewalls of laterally adjacent blocks are spaced laterally apart such that the left sidewall of an overlying block rests on the right sidewall of an underlying block and the right sidewall of the overlying block rests on the left sidewall of another underlying block.

In a preferred embodiment, the means for preventing lateral displacement comprises at least one step disposed on one of the sidewalls such that it is abutable in a transverse direction with an underlying or overlying block which is vertically adjacent thereto. In this embodiment, the at least one step can comprise upper steps extending vertically from upper surfaces of the sidewalls and lower steps extending vertically from lower surfaces of the sidewalls.

Another object of the present invention is to provide a landscaping block which includes means for preventing longitudinal displacement of the individual blocks when assembled in a retaining wall such that the sidewalls of each of the blocks are parallel to each other and the sidewalls of laterally adjacent blocks are spaced laterally apart with the left sidewall of an overlying block resting on the right sidewall of an underlying block and the right sidewall of the overlying block resting on the left sidewall of another underlying block. In this case, the means for preventing longitudinal displacement can comprise at least one transversely extending step disposed on the bottom wall such that it is abutable in the longitudinal direction with an overlying or underlying block which is vertically adjacent thereto.

In the preferred embodiment, the landscaping block includes a horizontally extending bottom wall, a pair of laterally spaced-apart sidewalls extending in a longitudinal direction and vertically upwardly from the bottom wall and a front end wall extending in a transverse direction between the sidewalls and vertically upwardly from a front end of the bottom wall. In another embodiment, the block includes a rear end wall extending between the sidewalls at a rear end of the bottom wall.

In the preferred embodiment, the means for preventing longitudinal and lateral displacement of the individual blocks when assembled in a retaining wall includes a first step extending in the longitudinal direction on an upper surface of the first sidewall, a second step extending in the longitudinal direction on an upper surface of the second sidewall, a third step extending in the longitudinal direction on a lower surface of the bottom wall beneath the first sidewall, a fourth step extending in the longitudinal direction on the lower surface of the bottom wall beneath the second sidewall and a fifth step extending in the transverse direction on the lower surface of the bottom wall at an end of the bottom wall opposite to the end at which the end wall is located. The upper surface of the first sidewall can lie in a plane containing the upper surface of the second sidewall and the first and second steps can extend upwardly away from this plane. The first step can include a first section and a second section, the first section being spaced apart from the upper surface of the first sidewall and the second section extending between the first section and the upper surface of the first sidewall. The second step can be arranged in the same fashion on the second sidewall.

In the preferred embodiment, the first section of the first step can lie in a plane containing the first section of the second step. Alternatively, the first sections of the first and second steps could be angled with respect to a horizontal plane but preferably, the first and second steps are mirror images of each other on either side of a longitudinally and vertically extending median plane passing through the block. The second section of the first step could be located between the first section of the first step and the outer side surface of the first sidewall. In the preferred embodiment, however, the first section of the first step is located between the second section of the first step and the outer side surface of the first sidewall. Furthermore, while the second section of the first step can extend at any angle to the upper surface of the first sidewall, it is preferred that the second section of the first step form an obtuse angle with the upper surface of the first sidewall.

In the preferred embodiment, the first sidewall includes an outer side surface and an inner side surface which converge towards each other in a direction away from the bottom wall. In this embodiment, the second sidewall has the same configuration as the first sidewall.

With this arrangement, the inner side surface of the second sidewall of an underlying block aligns with an outer side surface of a first sidewall of an overlying block when the third step of the overlying block bears on and abuts against the second step of the underlying block. This arrangement provides a smooth transition of the sidewalls from the underlying blocks to the overlying blocks.

With the inventive arrangement, the first and second steps can be discontinuous along the sidewalls but it is preferred that these steps be continuous along the sidewalls. Likewise, although the third, fourth and fifth steps can be discontinuous along the length thereof, it is preferred that these steps be continuous along their length and with each other. Furthermore, the third, fourth and fifth steps can each include a first section and a second section, the first section being spaced from the lower surface of the bottom wall and the second section extending between the lower surface of the bottom wall and the first section. Although the second section of the third, fourth and fifth steps could be located between the first section and an outer side surface of the block, it is preferred that the first section of these steps be located between the second section and the outer side surfaces of the block. Also, it is preferred that the first sections of the third and fourth steps lie in a common plane spaced downwardly from the lower surface of the bottom wall. Although the first section of the fifth step could be located at a different distance from the lower surface of the bottom wall than the first sections of the third and fourth steps, it is preferred that the first section of the fifth step be coplanar with the first sections of the third and fourth steps. As with the first and second steps, the second sections of the third, fourth and fifth steps can be at any angle but preferably form an obtuse angle with the lower surface of the bottom wall.

In the preferred embodiment, the end wall located at an end of the bottom wall opposite to the fifth step has a height greater than the height of the sidewalls, that is, the uppermost part of the end wall is spaced further from the bottom wall than the uppermost parts of the first and second sidewalls are spaced from the bottom wall. With this arrangement, the end wall is preferably a front end wall.

The landscaping block according to the present invention can be assembled with a plurality of identical blocks such that a second one of the blocks overlies a first one of the blocks with the third step of the second block bearing on the upper surface of the second sidewall of the first block and the lower surface of the second block bearing on the second step of the first block. In addition, the second section of the third step of the second block abuts against the second section of the second step of the first block. With this arrangement, the overlying second block can contact the underlying first block along three surfaces, that is, the upper surface of the second sidewall and the first and second sections of the second step on the first block can contact the lower surface of the bottom wall and the first and second sections of the third step of the second block.

With the arrangement of blocks according to the invention, it is possible to provide maximum coverage of a surface area of a slope to be retained with a minimum number of landscaping blocks. Furthermore, to prevent the front end walls of the overlying and underlying blocks from contacting each other, each block can include the fifth step depending from the lower surface of the bottom wall at an end thereof opposite to the end at which the front end wall is located. The fifth step is vertically engageable with an end portion of the first step of a first underlying block and an end portion of the second step of a second underlying block. Such an arrangement is particularly advantageous in constructing a retaining wall having a steep vertical angle since the fifth step can have a thickness in the longitudinal direction sufficient to prevent the front end walls of overlying blocks from pressing on the front end walls of underlying blocks. Furthermore, the lower surface of the bottom wall can be flat in the preferred embodiment which is advantageous in forming a retaining wall which has turns or bends, that is, the lower surface of the bottom wall can rest on the first sections of the first and second steps of underlying blocks so that the retaining wall remains level through such turns since the lower surface of the bottom wall in this case is not curved with respect to a horizontal plane. In other words, if the lower surface of the bottom Wall is convex in shape, the height of the block can change relative to laterally adjacent blocks depending on where the uppermost surfaces of the first and second steps of the underlying blocks contact such a curved lower surface. In the case of turns, however, it is preferred to provide the rear end wall in the blocks for stiffening purposes and for supporting the third and fourth steps of overlying blocks. When the rear end wall is used it is also advantageous to provide a drain hole in the bottom wall.

BRIEF DESCRIPTION OF THE DRAWINGS

The following description of the invention makes reference to the accompanying drawings, in which.

DETAILED DESCRIPTION OF THE PREFERRED EMBODIMENTS

Figure 1:
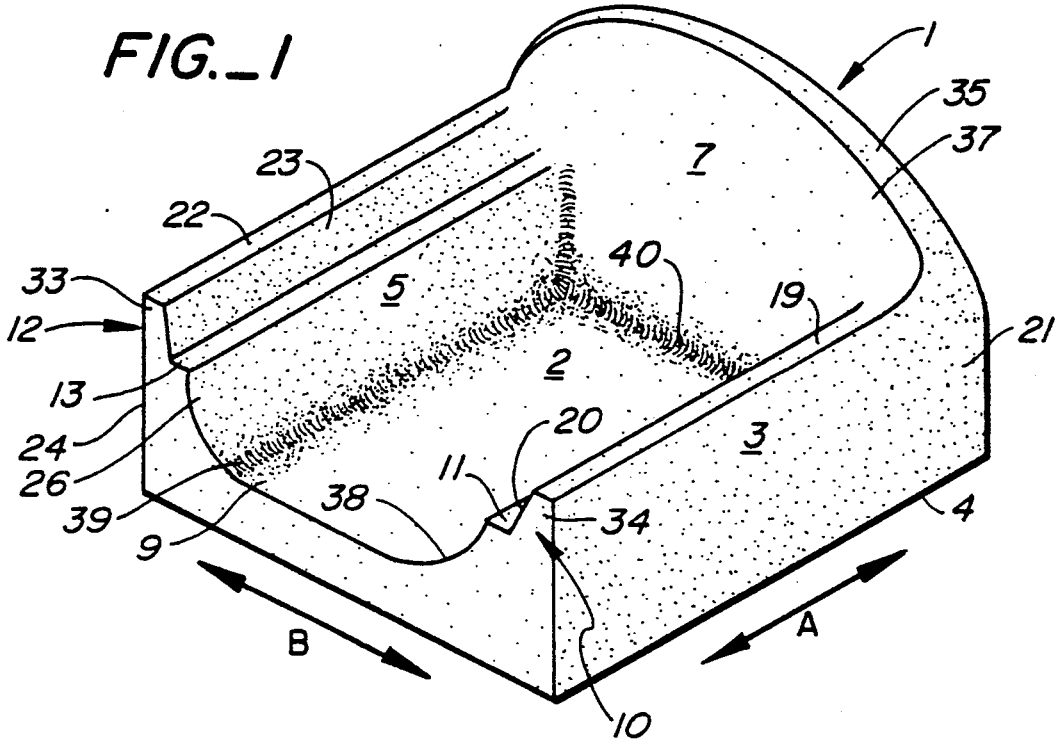
FIG. 1 is a perspective view from above of one embodiment of the landscaping block according to the invention.
Figure 5:
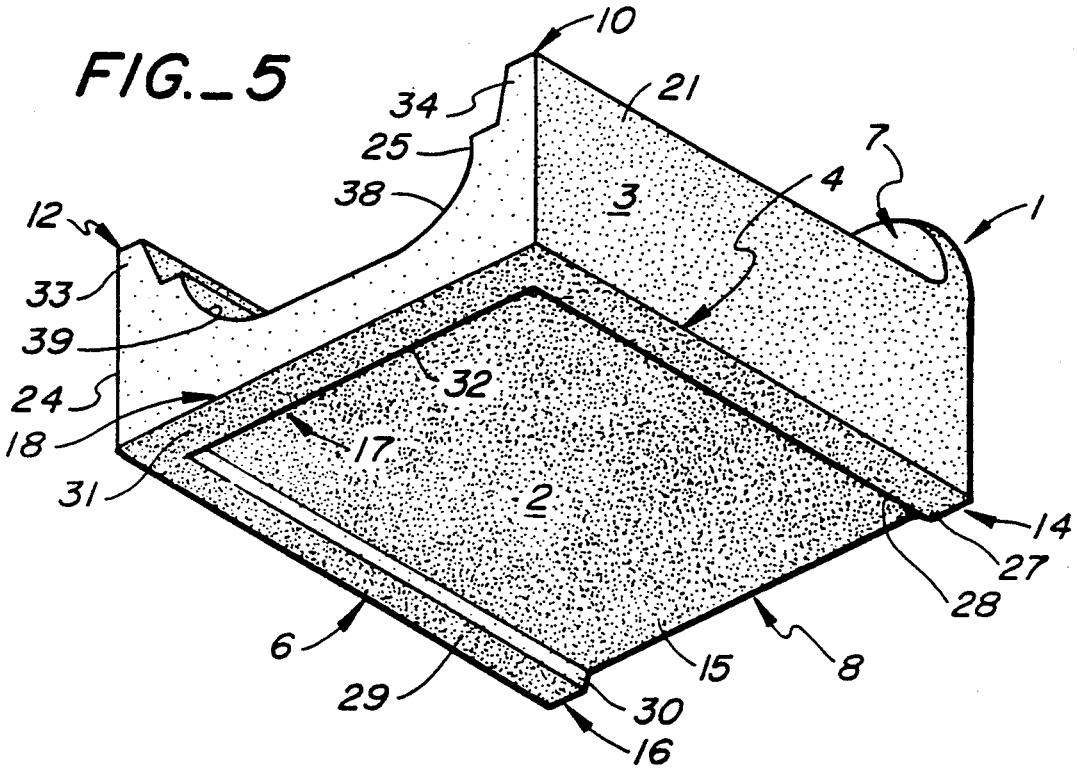
FIG. 5 is a perspective view from below of the block shown in FIG. 1.
Figure 2:
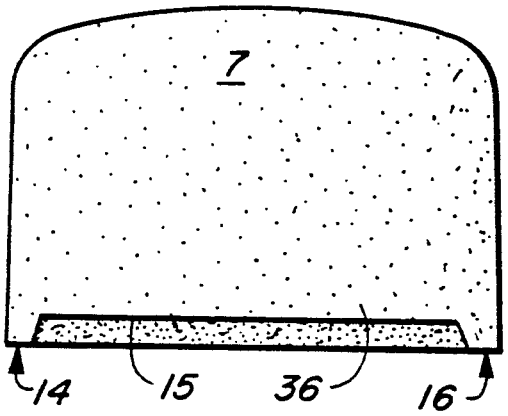
FIG. 2 is a rear view of the block shown in FIG. 1.
Figure 7:
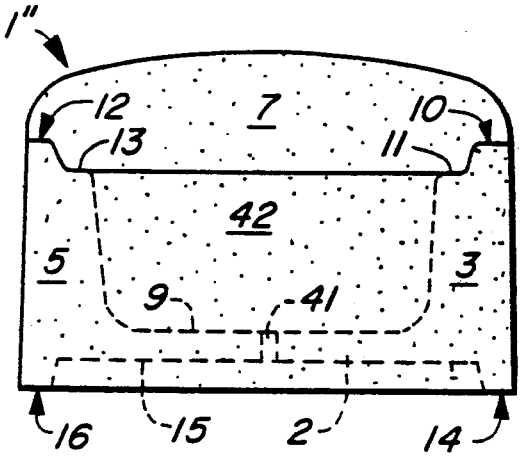
FIG. 7 is a front view of the block shown in FIG. 1.
Figure 8:
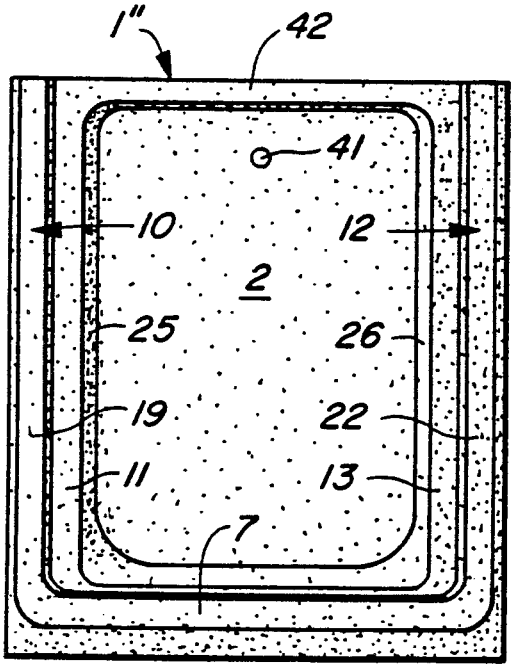
FIG. 8 is a top view of the block shown in FIG. 6.
Figure 6:
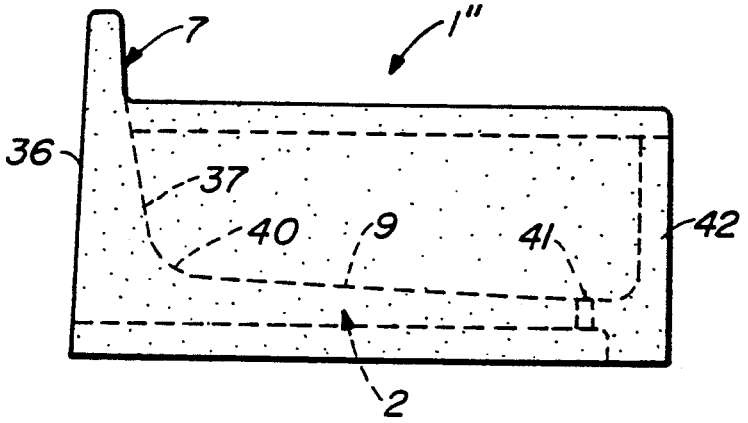
FIG. 6 shows a side view of a second embodiment of the landscaping block according to the invention wherein a rear end wall is provided.
Figure 9:
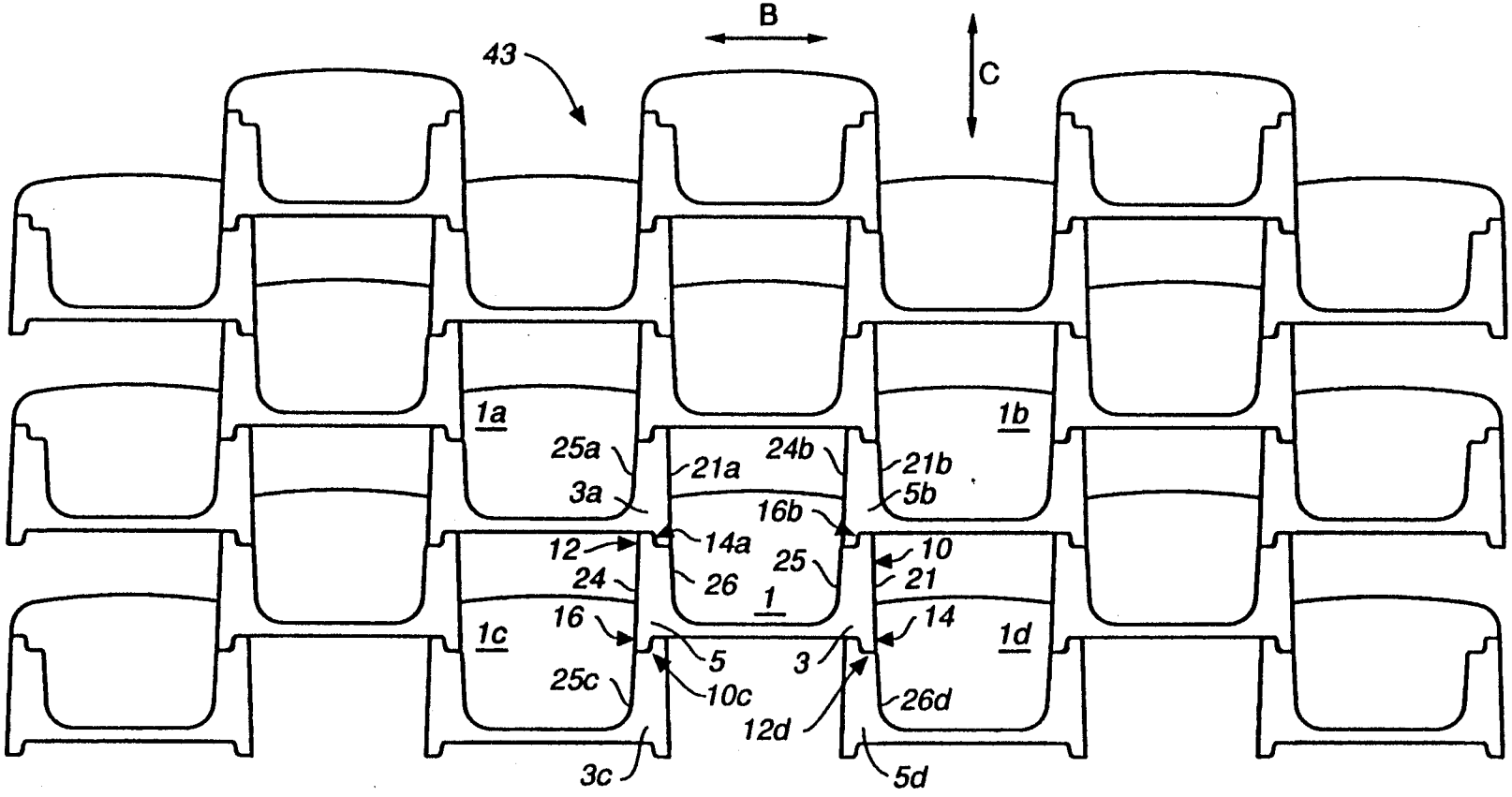
FIG. 9 is a rear view of a retaining wall made up of blocks according to the invention.

The present invention provides a landscaping block 1 useful for building retaining walls 43 as shown in FIG. 9. A first preferred embodiment of the block 1 is shown in FIGS. 1–5 and another preferred embodiment of the block 1 is shown in FIGS. 6–8.

As shown in FIGS. 1–5, the preferred embodiment of the landscaping block 1 according to the present invention includes a bottom wall 2, a first sidewall 3 extending in a longitudinal direction A along a first side 4 of the bottom wall 2, a second sidewall 5 extending in the longitudinal direction along a second side 6 of the bottom wall and an end wall 7 extending in a lateral direction B along a first end 8 of the bottom wall 2 and between the first and second sidewalls. The sidewalls 3, 5 and the end wall 7 extend upwardly away from an upper surface 9 of the bottom wall 2.

The landscaping block 1 includes means to prevent lateral and longitudinal displacement of a plurality of such blocks when assembled in a retaining wall 43 as shown in FIG. 9. In particular, the means for preventing lateral displacement includes a first step 10 extending in the longitudinal direction on an upper surface 11 of the first sidewall 3, a second step 12 extending in the longitudinal direction on an upper surface 13 of the second sidewall 5, a third step 14 extending in the longitudinal direction on a lower surface 15 of the bottom wall 2, the third step 14 being located adjacent the first sidewall 3 and a fourth step 16 extending in the longitudinal direction on the lower surface 15 of the bottom wall 2, the fourth step 16 being located adjacent the second sidewall 5. As shown in FIG. 9, the first step 10 and third step 14 form a side rail on one side of the block. Likewise, the second step 12 and the fourth step 16 form another side rail along the opposite side of the block. With this arrangement, a plurality of such blocks can be assembled to form the retaining wall 43 such that the second step 12 of a first block 1 engages a third step 14*a* of a second block 1*a*, the first step 10 of the first block 1 engages a fourth step 16*b* of a third block 1*b*, the fourth step 16 of the first block 1 engages a first step 10*c* of a fourth block 1*c* and the third step 14 of the first block 1 engages a second step 12*d* of a fifth block 1*d*. As these steps overlap each other in the vertical direction C, the individual blocks are prevented from becoming displaced in the transverse direction B.

Figure 4:
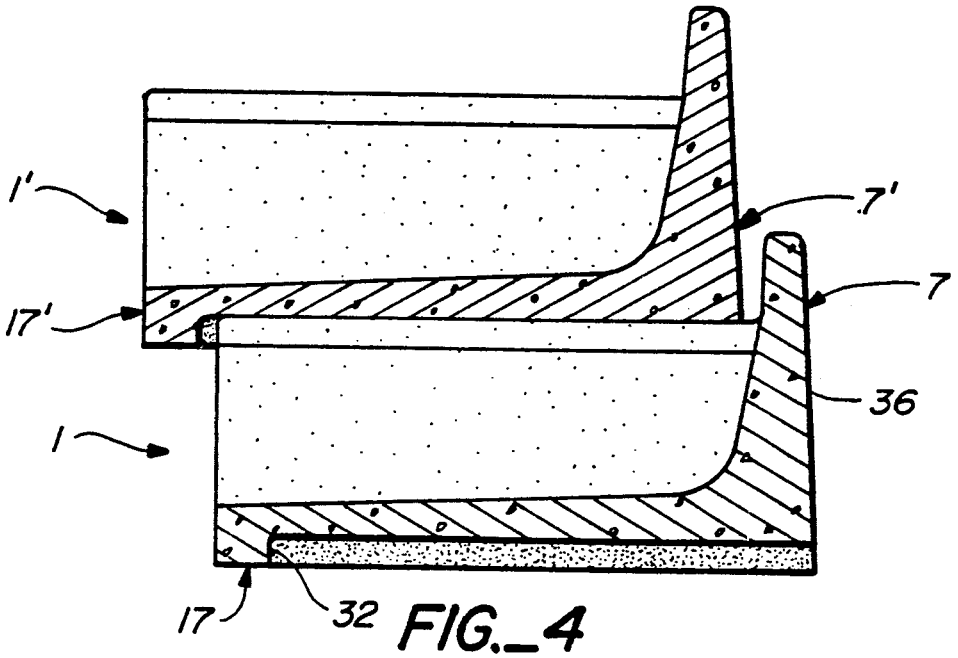
FIG. 4 is a side cut-away view of an overlying and underlying pair of blocks according to the invention in the assembled condition.

The means for preventing longitudinal displacement includes a fifth step 17 extending in the lateral direction B on the lower surface 15 of the bottom wall 2, the fifth step 17 being located adjacent a second end 18 of the bottom wall 2, the second end 18 of the bottom wall 2 being opposite to the first end 8 of the bottom wall 2. As shown in FIG. 4, the fifth step 17′ of an overlying block 1′ engages an upper and rear end of an underlying block 1. In particular, the fifth step 17′ engages rear ends of the first and second steps of the underlying block 1. With this arrangement, the front end wall 7′ on the overlying block 1′ is prevented from contacting the front end wall 7 of the underlying block 1, as shown in FIG. 4.

In the preferred embodiment, the first step 10 includes a first section 19 and a second section 20, the first section 19 being spaced from the upper surface 11 of the first sidewall 3 and the second section 20 extending between the first section 19 and the upper surface 11 of the first sidewall 3. The second step 12 is constructed in a like manner, that is, the second section 12 includes a first section 22 and a second section 23, the first section 22 being spaced from the upper surface 13 of the second sidewall 5 and the second section 23 extending therebetween. Accordingly, the upper surface 11 of the first sidewall 3 can lie in a plane containing the upper surface 13 of the second sidewall 5 with the first and second steps 10, 12 extending upwardly therefrom. Furthermore, the first section 19 of the first step 10 can lie in the same plane as the first section 22 of the second step 12. In the preferred embodiment, the first step 10 is located between the upper surface 11 of the first sidewall 3 and an outer side surface 21 of the first sidewall 3. In this case, the first section 19 is located between the second section 20 and the outer side surface 21. In a similar manner, the second step 12 is located between the upper surface 13 of the second sidewall 5 and an outer side surface 24 of the second sidewall 5. With this arrangement, the blocks are prevented from separating in the lateral direction due to the interlocking of the upper and lower steps, as shown in FIG. 9. Alternatively, the second sections 20, 23 could be located between the first sections 19, 22 and the outer side surfaces 21, 24 but such an arrangement would not be as effective in holding the blocks together. The second section 20 of the first step 10 could extend perpendicularly from the upper surface 11 of the first sidewall 3 but in the preferred embodiment, the second section 20 forms an obtuse angle with the upper surface 11. The second section 23 of the second step 12 is formed in a similar manner to the second section 20 of the first step 10. In fact, it is preferred that the first sidewall 3 and the first step 10 be symmetrical with the second sidewall 5 and the second step 12 with respect to a median vertical plane passing through the block 1.

In the preferred embodiment, the first sidewall 3 includes the outer side surface 21 and an inner side surface 25 which converge towards each other in a direction away from the bottom wall 2. Likewise, the second sidewall 5 includes the outer side surface 24 and an inner side surface 26 which converge towards each other in a direction away from the bottom wall 2. With this arrangement, the inner side surface 26 of the second sidewall 5 is adapted to align with the outer side surface 21 of an overlying block. This arrangement is shown in FIG. 9 wherein the outer side surface 21*a* of a right sidewall 3*a* of an overlying block 1*a* aligns with the inner side surface 26 of the left sidewall 5 of an underlying block 1. Likewise, the outer side surface 24 of the left sidewall 5 of the overlying block 1 aligns with the inner side surface 25*c* of the right sidewall 3*c* of an underlying block 1*c*. Furthermore, the outer side surface 24*b* of the left sidewall 5*b* of an overlying block 1*b* aligns with the inner side surface 25 of the right sidewall 3 of the underlying block 1 and the outer side surface 21 of the right sidewall 3 of the overlying block 1 aligns with the inner side surface 26*d* of the left sidewall 5*d* of the underlying block 1*d*. As such, the landscaping blocks according to the present invention cover a maximum area with a minimum number of blocks.

Figure 3:
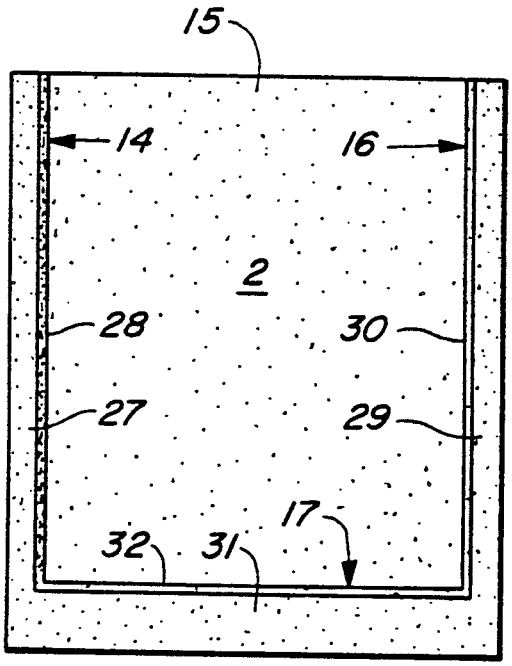
FIG. 3 is a bottom view of the block shown in FIG. 1.

Although discontinuous steps could be used, in the preferred embodiment the first step 10 is continuous along the first sidewall 3, the second step 12 is continuous along the second sidewall 5 and the third step 14, the fourth step 16 and the fifth step 17 are continuous with each other along the bottom wall 2. As shown in FIG. 3, the fifth step 17 can be thicker in the longitudinal direction than the third and fourth steps 14, 16 are in the transverse direction. The additional thickness of the fifth step 17 prevents the end wall 7 of an underlying block 1 from contacting the end wall 7′ of an overlying block 1′ as shown in FIG. 4.

As with the first and second steps 10, 12, the third step 14 includes a first section 27 and a second section 28, the first section 27 being spaced from the lower surface 15 of the bottom wall and the second section 28 extending between the lower surface of the bottom wall 2 and the first section 27. Likewise, the fourth step 16 includes a first section 29 and a second section 30, the first section 29 being spaced from the lower surface 15 of the bottom wall 2 and the second section 30 extending between the first section 29 and the lower surface 15. Similarly, the fifth step 17 includes a first section 31 and a second section 32, the first section 31 being spaced from the lower surface 15 and the second section 32 extending between the lower surface 15 and the first section 31.

In the preferred embodiment, the first section 27 of the third step 14 is located between the outer side surface 21 of the first sidewall 3 and the second section 28, the first section 29 of the fourth step 16 is located between the outer side surface 24 of the second sidewall 5 and the second section 30 and the first section 31 of the fifth step 17 is located between the second end 18 of the bottom wall 2 and the second section 32. Alternatively, the second sections 28, 30, 32 could be located between the first sections 27, 29, 31 and the outer side surfaces of the block but such an arrangement is not preferred since it would not provide the more effective interlocking shown in FIG. 9. Furthermore, the first section 27 of the third step 14 and the first section 29 of the fourth step 16 are coplanar with each other. Although the first section 31 of the fifth step 17 need not lie in the same plane as the first sections of the third and fourth steps, in the preferred embodiment the first sections of the third, fourth and fifth steps lie in a common plane. Furthermore, the lower surface 15 of the bottom wall 2 is flat and extends from a front surface of the end wall 7 in the preferred embodiment. The fifth step 17 is vertically engageable with an upper end 33 of the second step 12 of an underlying block and also is vertically engageable with an upper end 34 of the first step 10 of a different underlying block.

In the preferred embodiment, the end wall 7 includes an uppermost part 35 which is spaced further from the bottom wall 2 than uppermost parts of the sidewalls 3, 5. Alternatively, the uppermost part 35 of the end wall 7 could be spaced closer to the bottom wall 2 than the uppermost parts of the sidewalls or the uppermost part 35 could be coplanar with the uppermost parts of the sidewalls. The end wall 7 includes an outer surface 36 and an inner surface 37. The inner surface 37 of the end wall 7 can be connected to the upper surface 9 of the bottom wall 2 by a curved section 40. Likewise, the inner surface 25 of the first sidewall 3 can be connected to the upper surface 9 by a curved section 38 and the inner surface 26 of the second sidewall 5 can be connected to the upper surface 9 by a curved section 39.

A second embodiment of the landscaping block according to the present invention is shown in FIGS. 6–8. In particular, the block 1'' according to this embodiment includes a rear wall 42. As shown in FIG. 7, the rear wall 42 can have an uppermost edge which is coplanar with the upper surfaces 11, 13 of the first and second sidewalls 3, 5. Otherwise, the block 1'' is identical to the block shown in FIGS. 1–5 except for the provision of an optional drain hole 41 in the bottom wall 2. As shown in FIG. 6, the upper surface 9 of the bottom wall 2 can be sloped toward the rear end wall 42 and the drain hole 41 can be located in an area adjacent the rear wall 42. The rear wall 42 provides additional stiffness to the block 1'' which is advantageous for blocks 1'' forming a turn or bend in a retaining wall. That is, when the blocks form such a bend in the retaining wall the lower steps 14, 16 of the overlying blocks do not necessarily rest on the upper surfaces 11, 13 of the sidewalls 3, 5 of the underlying blocks. In this case, the upper edge of the rear wall 42 of the underlying block is useful in supporting the lower steps 14, 16 of the overlying blocks. With or without the end wall 42, the lower surface 15 of the bottom wall 2 of the overlying block still rests on the upper steps 10, 12 of the underlying blocks.

The landscaping blocks according to the present invention are preferably formed of precast concrete but any suitable material can be used to form the blocks. As explained earlier, the sidewalls of the blocks extend both above and below the bottom wall and have steps which form a notch shape on their top and bottom surfaces which facilitates stacking of the blocks in a pattern which provides left-right horizontal interlocking of the blocks and vertical columnar load bearing when the blocks are utilized in constructing a retaining wall. The fifth step provides a lip across the width of the block protruding below the lower wall at the rear of the block or in the area beneath the rear wall if one is provided. This lip provides front-back horizontal interlocking of the blocks when they are utilized in constructing a retaining wall and locates the blocks stacked one level above another in the retaining wall such that they do not press on the rear surfaces of the front end walls of the underlying blocks. The lip also provides reinforcement of the bottom wall across its width. The blocks preferably do not have protrusions on either the inside or outside surfaces of the sidewalls or on the upper surface of the bottom wall and preferably no dividing or partitioning members are provided within the space between the sidewalls. The front end wall preferably does not protrude beyond the width of the sidewalls nor below the bottom of the sidewalls. On the other hand, the front end wall can extend to a height greater than that of the sidewalls. As can be appreciated from FIG. 9, the blocks within a course which extends horizontally from left to right do not contact each other but rather, the blocks of a particular horizontal course interlock with the blocks of overlying and underlying courses. This arrangement provides for maximum coverage of a slope to be retained with a minimum number of blocks.

While the invention has been described with reference to the foregoing embodiments, changes and variations may be made thereto which fall within the scope of the appended claims.

What is claimed is:

1. A landscaping block comprising:

a bottom wall;

a first sidewall extending in a longitudinal direction along a first side of said bottom wall;

a second sidewall extending in said longitudinal direction along a second side of said bottom wall;

an end wall extending in a transverse direction along a first end of said bottom wall and between said first sidewall and said second sidewall;

said first sidewall, said second sidewall and said end wall extending upwardly away from an upper surface of said bottom wall; and means for preventing longitudinal and lateral displacement of individual blocks, each of which is identical to said block, when the blocks form a retaining wall wherein the end wall of each of the blocks faces the same direction, a lower end of the first sidewall of a first one of the blocks overlies an upper end of the second sidewall of a second one of the blocks and a lower end of the second sidewall of the first one of the blocks overlies an upper end of the first sidewall of a third one of the blocks, the means comprising:

a first step extending in said longitudinal direction on an upper surface of said first sidewall;

a second step extending in said longitudinal direction on an upper surface of said second sidewall;

a third step extending in said longitudinal direction on a lower surface of said bottom wall, said third step being located adjacent said first sidewall;

a fourth step extending in said longitudinal direction on said lower surface of said bottom wall, said fourth step being located adjacent said second sidewall; and a fifth step extending in said transverse direction on said lower surface of said bottom wall, said fifth step being located adjacent a second end of said bottom wall, said second end of said bottom wall being opposite to said first end of said bottom wall.

2. The landscaping block of claim 1, further comprising a second end wall which extends transversely between said first sidewall and said second sidewall along said second end of said bottom wall, said second end wall having an upper surface which lies in a plane containing said upper surface of said first sidewall and said upper surface of said second sidewall.

3. The landscaping block of claim 1, wherein said upper surface of said first sidewall lies in a first plane containing said upper surface of said second sidewall, said first step and said second step extending upwardly away from said plane, said first step including a first section and a second section, said first section being spaced apart from said upper surface of said first sidewall and said second section extending between said first section and said upper surface of said first sidewall, said second step including a first section and a second section, said first section of said second step being spaced apart from said upper surface of said second sidewall and said second section of said second step extending between said first section of said second step and said upper surface of said second sidewall, said first section of said first step lying in a second plane containing said first section of said second step, said first section of said first step being located between said second section of said first step and an outer side surface of said first sidewall and said first section of said second step being located between said second section of said second step and an outer side surface of said second sidewall

4. The landscaping block of claim 3, wherein said second section of said first step forms a first obtuse angle with said upper surface of said first sidewall and said second section of said second step forms a second obtuse angle with said upper surface of said second sidewall, said first obtuse angle being equal to said second obtuse angle.

5. The landscaping block of claim 1, wherein said sidewalls at said second end of said bottom wall are connected together only at a lower end thereof such that a space between said first sidewall and said second sidewall is open at said second end.

6. The landscaping block of claim 1, wherein said first sidewall includes an outer side surface and an inner side surface which converge towards each other in a direction away from said bottom wall and said second sidewall includes an outer side surface and an inner side surface which converge towards each other in a direction away from said bottom wall, said inner side surface of said second sidewall of a first one of the blocks being adapted to align with said outer side surface of said first sidewall of a second one of the blocks when said third step of the second block overlies said second step of the first block.

7. The landscaping block of claim 1, wherein said first step is continuous along said first sidewall, said second step is continuous along said second sidewall and said third step, said fourth step and said fifth step are continuous with each other along said bottom wall.

8. The landscaping block of claim 1, wherein said third step includes a first section and a second section, said first section being spaced from said lower surface of said bottom wall and said second section extending between said lower surface of said bottom wall and said first section, said fourth step including a first section and a second section, said first section of said fourth step being spaced from said lower surface of said bottom wall and said second section of said fourth step extending between said first section of said fourth step and said lower surface of said bottom wall and, said fifth step including a first section and a second section, said first section of said fifth step being spaced apart from said lower surface of said bottom wall and said second section of said fifth step extending between said lower surface of said bottom wall and said first section of said fifth step, said first section of said third step being located between an outer side surface of said first sidewall and said second section of said third step, said first section of said fourth step being located between an outer side surface of said second sidewall and said second section of said fourth step, and said first section of said fifth step being located between said second end of said bottom wall and said second section of said fifth step, said lower surface of said bottom wall extending from a front surface of said end wall, said front surface being opposite to a rear surface of said end wall, said rear surface extending upwardly from an upper surface of said bottom wall.

9. The landscaping block of claim 8, wherein said first section of said third step, said first section of said fourth step and said first section of said fifth step lie in a common plane spaced downwardly from said lower surface of said bottom wall, said lower surface being flat.

10. The landscaping block of claim 9, wherein said second section of said third step forms an obtuse angle with said lower surface of said bottom wall, said second section of said fourth step forms an obtuse angle with said lower surface of said bottom wall, and said second section of said fifth step forms an obtuse angle with said lower surface of said bottom wall.

11. The landscaping block of claim 1, wherein an uppermost part of said end wall is spaced further from said bottom wall than uppermost parts of said first sidewall and said second sidewall are spaced from said bottom wall, said first sidewall including an inner side surface which is joined to an upper surface of said bottom wall by a curved section, said second sidewall including an inner side surface which is joined to an upper surface of said bottom wall by a curved section, and said end wall including a rear surface which is joined to an upper surface of said bottom wall by a curved section.

12. An assembly of landscaping blocks, each of which comprises:

a bottom wall, a first sidewall extending in a longitudinal direction along a first side of said bottom wall, a second sidewall extending in said longitudinal direction along a second side of said bottom wall, an end wall extending in a transverse direction along a first end of said bottom wall and between said first sidewall and said second sidewall, said first sidewall, said second sidewall and said end wall extending upwardly away from an upper surface of said bottom wall, a first step extending in said longitudinal direction on an upper surface of said first sidewall, a second step extending in said longitudinal direction on an upper surface of said second sidewall, a third step adjacent to said first sidewall and extending in said longitudinal direction on a lower surface of said bottom wall, a fourth step adjacent to said second sidewall and extending in said longitudinal direction on said lower surface of said bottom wall, and a fifth step extending in said transverse direction on said lower surface of said bottom wall, said fifth step being located adjacent a second end of said bottom wall, said second end of said bottom wall being opposite to said first end of said bottom wall, a second one of said blocks overlying a first one of said blocks with said third step of said second block bearing on said upper surface of said second sidewall of said first block and said lower surface of said bottom wall of said second block bearing on said second step of said first block.

13. The assembly of claim 12, wherein said first sidewall of said second block includes an outer side surface and an inner side surface which converge towards each other in a direction away from said bottom wall of said second block, said second sidewall of said first block including an outer side surface and an inner side surface which converge towards each other in a direction away from said bottom wall of said first block, said inner side surface of said second sidewall of said first block being aligned with said outer side surface of said first sidewall of said second block.

14. The assembly of claim 12, wherein said fifth step of said second block abuts an end portion of said second step of said first block.

15. The assembly of claim 13, wherein a third one of said blocks overlies said first block with said fourth step of said third block bearing on said upper surface of said first sidewall of said first block and said lower surface of said bottom wall of said third block bearing on said first step of said first block.

16. The assembly of claim 15, wherein said second sidewall of said third block includes an outer side surface and an inner side surface which converge towards each other in a direction away from said bottom wall of said third block, said first sidewall of said first block including an outer side surface and an inner side surface which converge towards each other in a direction away from said bottom wall of said first block, said inner side surface of said first sidewall of said first block being aligned with said outer side surface of said second sidewall of said third block.

17. A landscaping block comprising:

a horizontally extending bottom wall;

a pair of laterally spaced-apart sidewalls comprising a left sidewall and a right sidewall extending in a longitudinal direction and extending vertically upwardly from said bottom wall;

a front end wall extending in a transverse direction between said sidewalls and extending vertically upwardly from a front end of said bottom wall; and means for vertically engaging and preventing lateral displacement of individual blocks, each of which is identical to said block, when the blocks form a retaining wall wherein the sidewalls of each of the blocks are parallel to each other and the sidewalls of laterally adjacent one of the blocks are spaced laterally apart such that the left sidewall of an overlying one of the blocks rests on the right sidewall of a first underlying one of the blocks and the right sidewall of the overlying one of the blocks rests on the left sidewall of a second underlying one of the blocks, said means comprising at least one step disposed on one of said sidewalls and abutable in said transverse direction with a vertically adjacent one of the blocks.

18. The block of claim 17 wherein said at least one step extends vertically from one of said sidewalls.

19. The block of claim 17, further comprising means for preventing longitudinal displacement of the individual blocks, the longitudinal displacement preventing means comprising at least one transversely extending step disposed on said bottom wall and abutable in said longitudinal direction with a vertically adjacent one of the blocks.

20. The block of claim 18, wherein said at least one step comprises upper steps on upper surfaces of said sidewalls and lower steps on lower surfaces of said sidewalls.

* * * * *